US008116643B2

(12) United States Patent
Nagai

(10) Patent No.: US 8,116,643 B2
(45) Date of Patent: Feb. 14, 2012

(54) IMAGE FORMING APPARATUS, METHOD OF CONTROLLING IMAGE FORMING APPARATUS, PROGRAM, AND STORAGE MEDIUM

(75) Inventor: Jun Nagai, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 416 days.

(21) Appl. No.: 12/364,114

(22) Filed: Feb. 2, 2009

(65) Prior Publication Data

US 2009/0214231 A1 Aug. 27, 2009

(30) Foreign Application Priority Data

Feb. 22, 2008 (JP) ..... 2008-042072

(51) Int. Cl.
*G03G 15/08* (2006.01)

(52) U.S. Cl. ..... 399/27

(58) Field of Classification Search ..... 399/9, 24, 399/27–30, 53, 61–65; 358/1.16, 1.7, 296, 358/406

See application file for complete search history.

(56) References Cited

U.S. PATENT DOCUMENTS

| | | | | |
|---|---|---|---|---|
| 5,652,947 | A | 7/1997 | Izumizaki | |
| 6,754,455 | B2 * | 6/2004 | Kawase | 399/27 |
| 6,895,193 | B2 | 5/2005 | Takamatsu et al. | |
| 7,505,700 | B2 * | 3/2009 | Kitora | 399/27 |
| 7,564,584 | B2 * | 7/2009 | Takahashi et al. | 358/2.1 |
| 7,657,194 | B2 * | 2/2010 | Tanaka et al. | 399/30 |
| 7,804,629 | B2 * | 9/2010 | Jacobs et al. | 358/504 |
| 2004/0042805 | A1 | 3/2004 | Takamatsu et al. | |

FOREIGN PATENT DOCUMENTS

| | | | |
|---|---|---|---|
| CN | 1469211 | A | 1/2004 |
| JP | 5-134550 | A | 5/1993 |
| JP | 5-323791 | A | 12/1993 |
| JP | 2003-270881 | A | 9/2003 |

OTHER PUBLICATIONS

Notification of First Office Action dated Dec. 6, 2010, in counterpart Chinese Application No. 200910005356.3.

* cited by examiner

*Primary Examiner* — Hoan Tran
(74) *Attorney, Agent, or Firm* — Fitzpatrick, Cella, Harper & Scinto

(57) ABSTRACT

An image forming apparatus having a development unit which develops an electrostatic latent image formed on an image carrier to form a visible image, the apparatus has an input unit adapted to accept input of a print job; an analysis unit adapted to analyze contents of image data included in the print job and contents of a print setting for controlling printout based on the image data; a prediction unit adapted to predict, based on an analysis result by the analysis unit, a consumption amount of a developing material necessary to develop an electrostatic latent image by the development unit when an electrostatic latent image based on the image data is formed; and a supply control unit adapted to control, based on the consumption amount of the developing material that is predicted by the prediction unit, a supply unit which supplies the developing material to the development unit.

14 Claims, 14 Drawing Sheets

PRIOR ART

PRIOR ART

| PageID | TONER AMOUNT |
|---|---|
| 1 | 40% |
| 2 | 25% |

| PageID | TONER AMOUNT |
|---|---|
| 1 | 10% |
| 2 | 10% |
| 3 | 50% |
| 4 | 50% |
| 5 | 25% |
| 6 | 25% |

| PageID | TONER AMOUNT |
|---|---|
| 1 | 10% |
| 2 | 50% |
| 3 | 25% |
| 4 | 10% |
| 5 | 50% |
| 6 | 25% |

| PageID | TONER AMOUNT |
|---|---|
| 1 | 0% |
| 2 | 35% |
| 3 | 35% |
| 4 | 25% |

FIG. 12B

| | | IMAGE | GRAPHICS | TEXT |
|---|---|---|---|---|
| Cyan | GAIN | $GAIN_{ci}$ | $GAIN_{cg}$ | $GAIN_{ct}$ |
| | OFFSET | $OFFSET_{ci}$ | $OFFSET_{cg}$ | $OFFSET_{ct}$ |
| Magenta | GAIN | $GAIN_{mi}$ | $GAIN_{mg}$ | $GAIN_{mt}$ |
| | OFFSET | $OFFSET_{mi}$ | $OFFSET_{mg}$ | $OFFSET_{mt}$ |
| Yellow | GAIN | $GAIN_{yi}$ | $GAIN_{yg}$ | $GAIN_{yt}$ |
| | OFFSET | $OFFSET_{yi}$ | $OFFSET_{yg}$ | $OFFSET_{yt}$ |
| Black | GAIN | $GAIN_{ki}$ | $GAIN_{kg}$ | $GAIN_{kt}$ |
| | OFFSET | $OFFSET_{ki}$ | $OFFSET_{kg}$ | $OFFSET_{kt}$ |

IMAGE FORMING APPARATUS, METHOD OF CONTROLLING IMAGE FORMING APPARATUS, PROGRAM, AND STORAGE MEDIUM

BACKGROUND OF THE INVENTION

1. Field of the Invention

The present invention relates to an image forming technique.

2. Description of the Related Art

Generally in image forming apparatuses such as copying machines and printers of an electrophotographic method and electrostatic printing method, it is necessary to supply a developing material at a proper timing in order to maintain high-quality image output. In terms of color reproduction, color image forming apparatuses which form full-color and multi-color images often use a developing material (two-component developing material) containing two components: a toner particle serving as a coloring material, and a magnetic powder called a carrier particle. In an image forming apparatus using the two-component developing material, the toner density (i.e., the ratio of the toner particle weight to the total weight of the carrier particle and toner particle) of the two-component developing material is very important to stabilize the image quality. The toner particle in the two-component developing material is consumed in development to change the toner density. For this reason, it is necessary to detect the toner density of the developing material in a development device at a proper timing by using a developing material density control device, supply toner in accordance with the change of the toner density, control the toner density to be always constant, and maintain the image quality.

In general, the developing material density control device includes a developing material density detector which detects the toner density of the two-component developing material in the development device, and a controller which controls to supply toner to the development device in accordance with a signal representing the detected toner density. As the arrangement of the developing material density detector, a light quantity detection type toner density detection sensor has conventionally been proposed. This sensor irradiates a two-component developing material with near infrared light on the development sleeve of a developing material carrier, and receives reflected light to detect the toner density.

FIGS. 1A and 1B are a sectional view and plan view, respectively, showing the schematic structure of a development device in a conventional image forming apparatus, and an example of a conventional optical reflected light quantity detection type toner density detection sensor used in the development device. FIG. 1B is a plan view of a developing device 101 shown in FIG. 1A when viewed from above. The developing device 101 is arranged to face an image carrier 102 such as a photosensitive member or dielectric. The interior of the developing device 101 is divided into a development chamber (first chamber) 104 and a stirring chamber (second chamber) 105 by a partition 103 extending in the vertical direction. The development chamber 104 and stirring chamber 105 store a two-component developing material containing a nonmagnetic toner and magnetic carrier.

The development chamber 104 and stirring chamber 105 incorporate screw type first and second developing material stirring/conveyance mechanisms 106 and 107, respectively. The first and second developing material stirring/conveyance mechanisms 106 and 107 function as a supply unit for supplying a stirred developing material. The first stirring/conveyance mechanism 106 stirs and conveys a developing material in the development chamber 104. The second stirring/conveyance mechanism 107 stirs and conveys toner supplied from a toner supply tank (not shown) via a toner supply port 108 arranged upstream of the second stirring/conveyance mechanism 107. At this time, the developing material in the stirring chamber 105 is also stirred and conveyed to make the toner density uniform. As is apparent from FIGS. 1A and 1B, developing material paths are formed on the two ends of the partition 103 to allow the development chamber 104 and stirring chamber 105 to communicate with each other. By a conveyance force in directions indicated by arrows A and B in the first and second stirring/conveyance mechanisms 106 and 107, a developing material in the development chamber 104 in which toner is consumed by development to decrease the toner density moves into the stirring chamber 105 via one path. A developing material which recovers the toner density in the stirring chamber 105 moves into the development chamber 104 via the other path.

The development chamber 104 has an opening at a position corresponding to the development area facing the image carrier 102. A development sleeve 109 serving as a developing material carrier is rotatably arranged to be partially exposed from the opening. The developing sleeve 109 is formed from a nonmagnetic material, and rotates in a direction indicated by an arrow in FIG. 1A in the development operation. A magnet serving as a magnetic field generator is fixed inside the developing sleeve 109. The developing sleeve 109 carries and conveys a layer of the two-component developing material, the thickness of which is regulated by a blade. In the development area facing the image carrier 102, the developing material is applied to a latent image on the image carrier 102, developing the latent image. To increase the development efficiency, that is, the ratio of toner applied to a latent image, a development bias voltage obtained by superposing DC and AC voltages is applied from a power supply 110 to the development sleeve 109.

An optical reflected light quantity detection type toner density detection sensor 111 is formed from an LED and photodiode. The LED emits light to the two-component developing material on the development sleeve 109. The photodiode detects reflected light whose quantity changes in accordance with a change of the toner amount, and converts the reflected light into an electrical signal. The difference between the signal value of the electric signal and a reference value is calculated. The developing material is supplied to the stirring chamber 105 via the toner supply port 108 by an amount determined in accordance with the difference. In order to correct changes of the output values of a light-emitting element and light-receiving element upon a change of the temperature, it is often to use a bidirectional emission LED and two photodiodes, receive direct light from the LED by the second photodiode, and set the detection output as a reference signal.

FIG. 2 is a flowchart showing a toner supply operation. When the printing operation starts and the development sleeve 109 and first and second developing material stirring/conveyance mechanisms 106 and 107 start rotating, the toner density detection sensor 111 detects the toner density of the developing material on the development sleeve 109 (S201). If necessary, the detection output is amplified. Then, the output is converted into a digital signal by an analog-to-digital converter (A/D converter), and the digital signal is supplied to an arithmetic circuit (S202). The arithmetic circuit compares the input signal with a reference signal to calculate the difference between them. The arithmetic circuit calculates the change amount of the toner density from the difference, and supplies a toner density change amount signal representing the change amount to a toner supply circuit (S203). The toner supply circuit converts the received toner density change amount signal into a toner supply amount (supply time) (S204). The second developing material stirring/conveyance mechanism 107 of the toner supply path is driven by a converted supply time to supply a predetermined amount of toner (S205).

As another method, an inductance detection type toner density detection sensor is used to detect the inductance of the developing material in the development device and obtain the toner density. As still another method, the toner density detection sensor detects a toner density from a reference image (toner image) patch formed on the image carrier. In all the three methods, the change amount of the toner density of a two-component developing material is obtained by the toner density detection sensor, and converted into a toner supply amount (supply time) to supply a predetermined amount of toner from the toner supply tank.

In addition to the above-described conventional methods, there is proposed a so-called video count type developing material density control device used particularly in a digital image forming apparatus (see, e.g., Japanese Patent Laid-Open No. 5-323791). According to the video count method, the output levels of all or some input image signals are converted for respective pixels to calculate the video count. The toner consumption amount is predicted from the video count to determine a toner supply amount so as to keep the toner density in the development unit constant.

However, in the conventional developing material density control based on a detected toner density, the toner supply amount is obtained from the toner density change amount of the developing material. The toner density of the developing material in the development chamber is fed back to supply toner. For example, when outputting an image which exhibits high density on the entire surface and consumes a large amount of toner, even the toner density which is uniform in the development unit before output abruptly decreases, making the output image unstable.

The video count type developing material density control can predict a toner consumption amount to a certain degree even for an output image for which the toner consumption amount greatly varies. However, the toner supply position is set upstream of the stirring chamber of the development device, as described above. It takes some time to move the developing material from the stirring chamber to the development chamber. Generally in the video count method, the toner supply amount is determined parallel to the rendering processing of an image signal to be printed, and toner is supplied at almost the same time as printing. Since neither movement nor diffusion of the developing material in the development unit is considered, the supply amount is not appropriate and the toner density becomes nonuniform.

SUMMARY OF THE INVENTION

The present invention has been made to overcome the conventional drawbacks, and has as its object to provide an image forming technique capable of analyzing the contents of a print job when performing print processing, predicting a toner consumption amount complying with the print order in accordance with print settings, predicting a toner density in the development unit, scheduling supply of toner, and supplying toner at a proper timing.

According to one aspect of the present invention, there is provided an image forming apparatus having a development unit which develops an electrostatic latent image formed on an image carrier to form a visible image, the apparatus comprising: an input unit adapted to accept input of a print job; an analysis unit adapted to analyze contents of image data included in the print job and contents of a print setting for controlling printout based on the image data; a prediction unit adapted to predict, based on an analysis result by the analysis unit, a consumption amount of a developing material necessary to develop an electrostatic latent image by the development unit when an electrostatic latent image based on the image data is formed; and a supply control unit adapted to control, based on the consumption amount of the developing material that is predicted by the prediction unit, a supply unit which supplies the developing material to the development unit.

According to another aspect of the present invention, there is provided a method of controlling an image forming apparatus having a development unit which develops an electrostatic latent image formed on an image carrier to form a visible image, the method comprising: an input step of accepting input of a print job; an analysis step of analyzing contents of image data included in the print job and contents of a print setting for controlling printout based on the image data; a prediction step of predicting, based on an analysis result in the analysis step, a consumption amount of a developing material necessary to develop an electrostatic latent image by the development unit when an electrostatic latent image based on the image data is formed; and a supply control step of controlling, based on the consumption amount of the developing material that is predicted in the prediction step, a supply unit which supplies the developing material to the development unit.

The present invention can predict a toner density in the development unit, schedule supply of toner, and supply toner at a proper timing.

Further features of the present invention will become apparent from the following description of exemplary embodiments with reference to the attached drawings.

BRIEF DESCRIPTION OF THE DRAWINGS

FIG. 12B is a table showing an example of setting gain values and offset values of respective colors for, for example, an image, graphics, and text as image data characteristics.

DESCRIPTION OF THE EMBODIMENTS

Preferred embodiments of the present invention will be exemplified in detail below with reference to the accompanying drawings. Components set forth in these embodiments are merely examples, and the technical scope of the present invention should be determined by the scope of the appended claims and is not limited to the individual embodiments to be described below.

The arrangement of an image forming apparatus is arbitrary as long as an electrostatic latent image is formed on an image carrier by an electrophotographic method, electrostatic printing method, or the like, and developed by a development device using a two-component developing material to form a visible image.

First Embodiment (Basic Arrangement of Image Forming Apparatus)

Figure 1A:
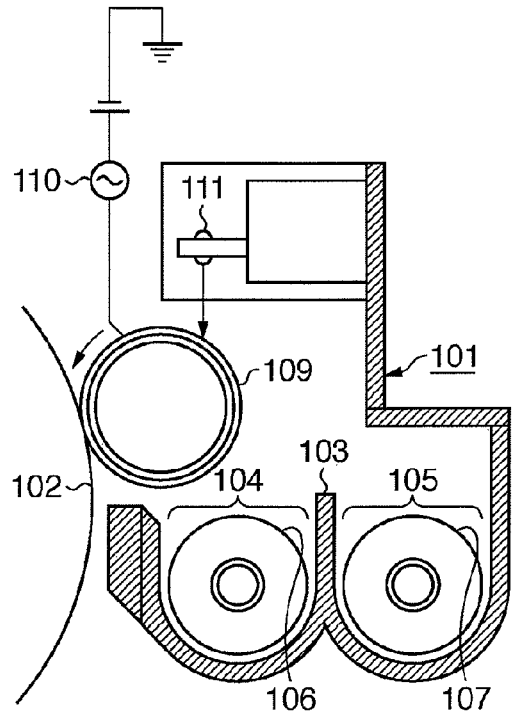
FIGS. 1A and 1B are a sectional view and plan view, respectively, showing the schematic structure of a development device in a conventional image forming apparatus, and an example of a conventional optical reflected light quantity detection type toner density detection sensor used in the development device.
Figure 1B:
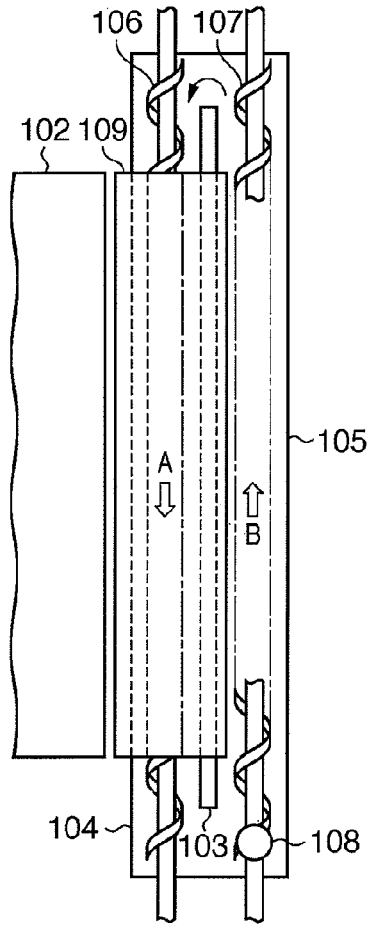
PRIOR ART FIG. 1B
Figure 2:
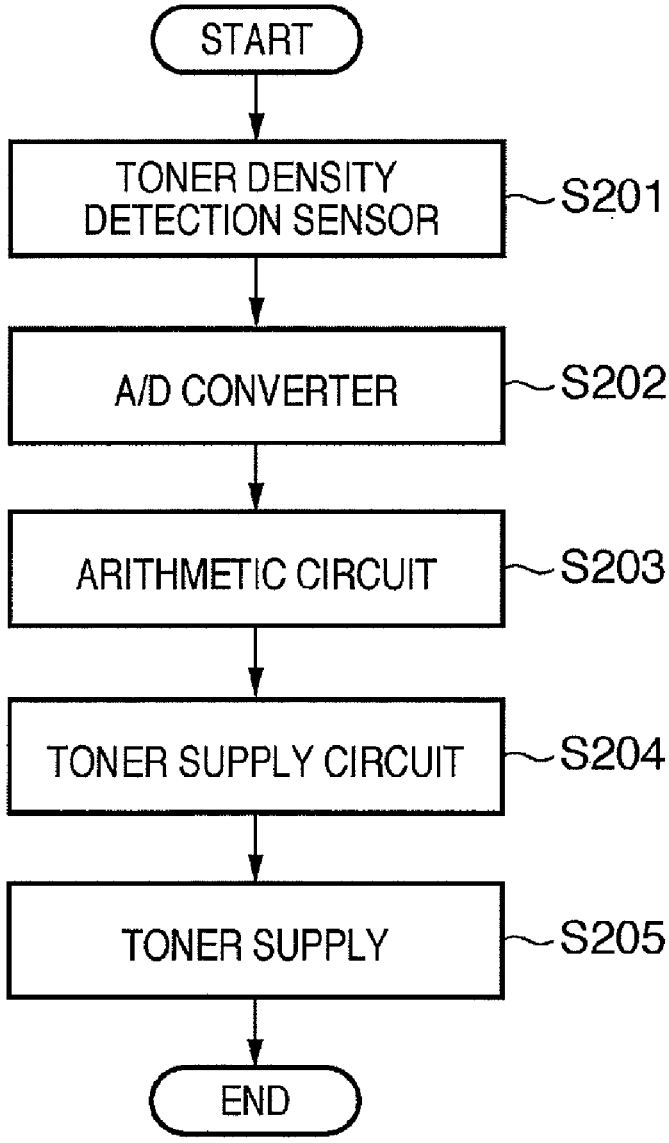
FIG. 2 is a flowchart showing a toner supply operation in the prior art.
Figure 3:
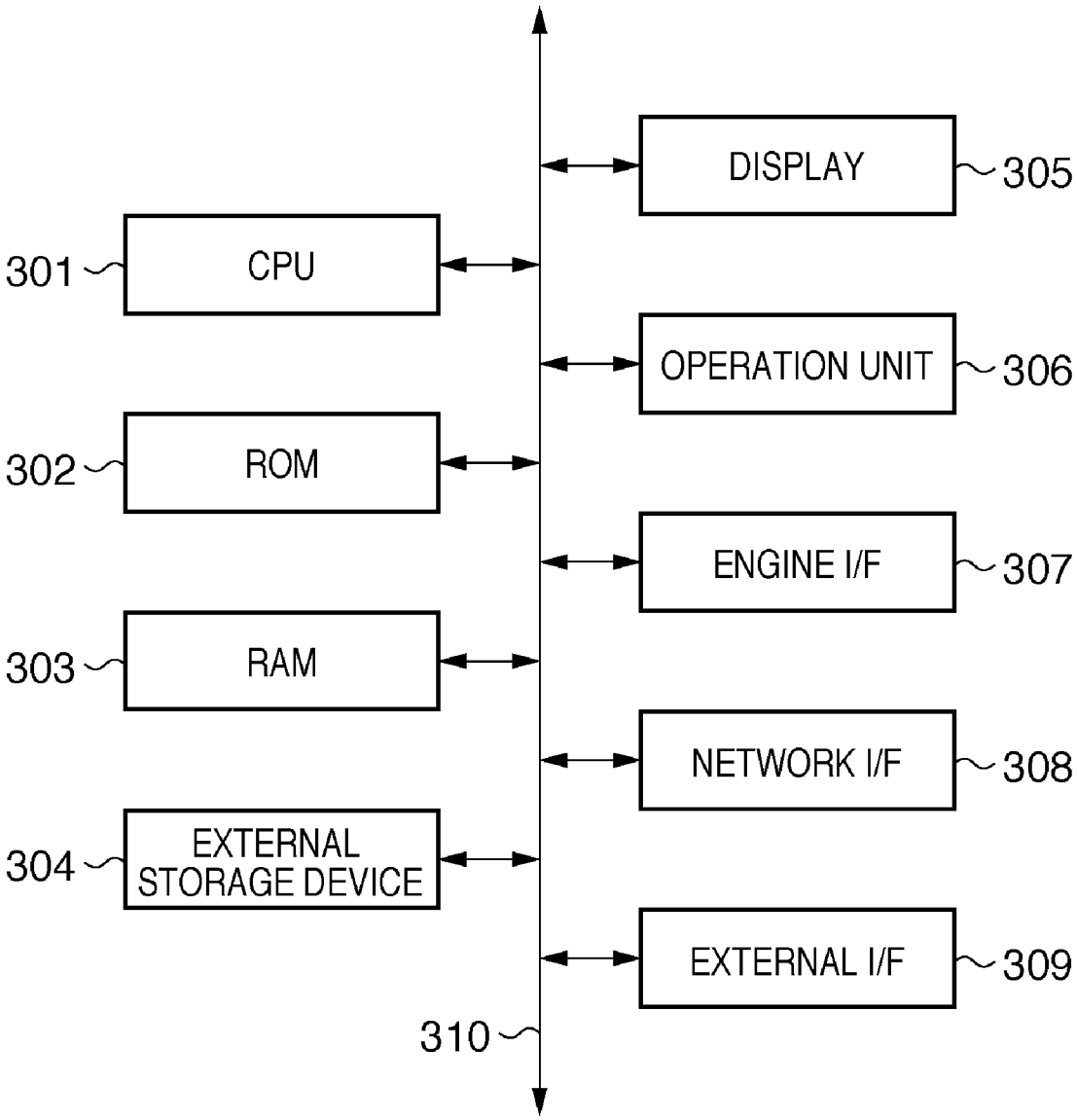
FIG. 3 is a block diagram showing the basic arrangement of an image forming apparatus according to an embodiment of the present invention.

FIG. 3 is a block diagram showing the basic arrangement of an image forming apparatus according to an embodiment of the present invention. The image forming apparatus has a plurality of functions such as an image reading function, image forming function, and image communication function. By executing the respective functions, the image forming apparatus can execute a print job to form an image on a print medium, and a scan job to scan an image from a document. The image forming apparatus can also execute a variety of jobs such as a FAX job to communicate an image with an external device, and a copy job to form an image read from a document onto a print medium. The image forming apparatus includes a CPU (Central Processing Unit) 301, ROM (Read Only Memory) 302, RAM (Random Access Memory) 303, external storage device 304, display 305, operation unit 306, engine interface 307, network interface 308, external interface 309, and system bus 310.

The CPU 301 performs overall control of the image forming apparatus, arithmetic processing, and the like. The CPU 301 executes each processing (to be described later) on the basis of a program stored in the ROM 302. The ROM 302 is a storage area for a startup program for starting up the image forming apparatus, a program for controlling the printer engine, character data, character code information, and the like.

The RAM 303 stores font data which is added and registered by downloading. Also, programs and data are loaded to the RAM 303 for respective processes, and executed. The RAM 303 is also available as a data storage area for received image data. The external storage device 304 is formed from a hard disk or the like. The external storage device 304 spools data, and stores programs, various information files, image data, attribute signals, and the like. The external storage device 304 is also used as a work area. The display 305 presents a display by liquid crystal or the like, and is used to display the apparatus setting state, the current process in the apparatus, an error state, and the like. The operation unit 306 is used to change and reset settings. Together with the display 305, the operation unit 306 can also display, for example, an operation window for print settings in output, which will be described later. The engine interface 307 actually exchanges a control command, toner supply command, and the like with the printer engine. The network interface 308 connects the image forming apparatus to a network. The external interface 309 is connected to a host computer via, for example, a parallel (or serial) interface. The system bus 310 serves as a data path between the above-described building components.

(Functional Arrangement of Image Forming Apparatus)

Figure 4:
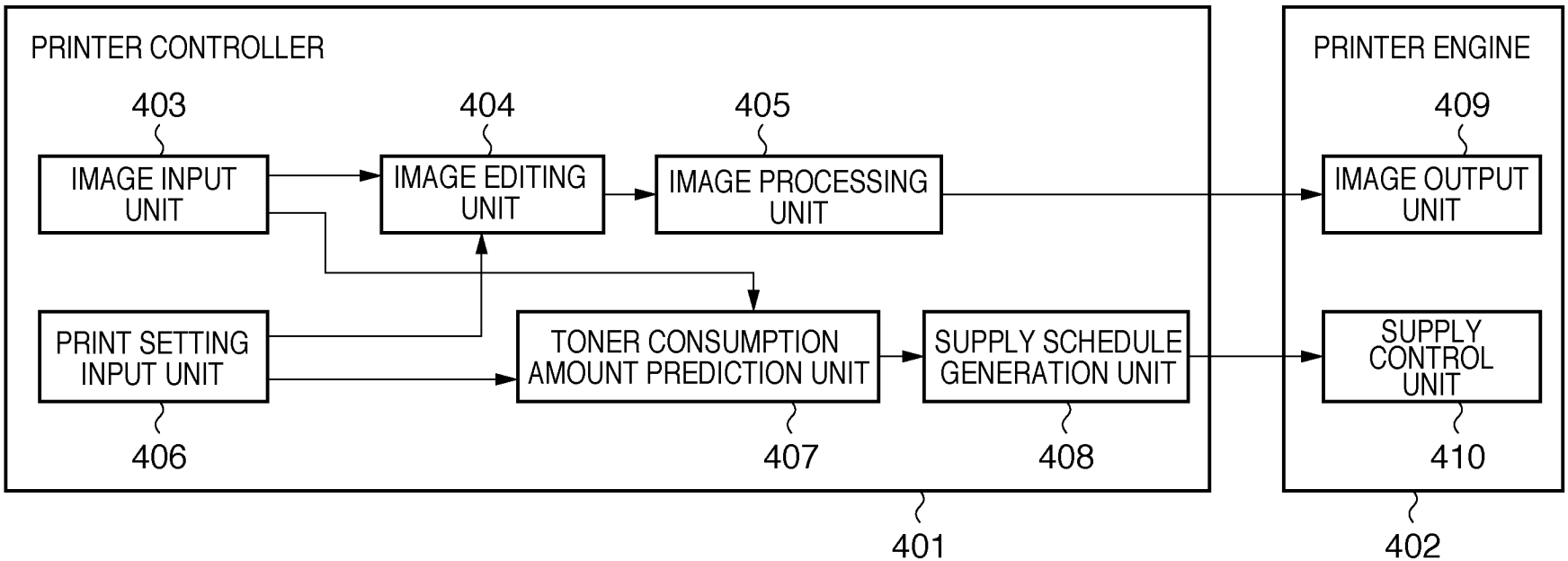
FIG. 4 is a block diagram showing the functional arrangement of the image forming apparatus according to the first embodiment.

FIG. 4 is a block diagram showing the functional arrangement of the image forming apparatus according to the first embodiment of the present invention. A printer controller 401 includes an image input unit 403, image editing unit 404, image processing unit 405, print setting input unit 406, toner consumption amount prediction unit 407, and supply schedule generation unit 408. A printer engine 402 includes an image output unit 409 and supply control unit 410. Data output from the image processing unit 405 is input to the image output unit 409, and processed by it. A developing material (toner) supply schedule generated by the supply schedule generation unit 408 is input to the supply control unit 410. Based on the supply schedule, the supply control unit 410 controls the toner supply amount to a development unit, and the timing to start toner supply.

Image data to be printed is input to the image input unit 403. The image input unit 403 can receive image data transmitted from, for example, an information processing apparatus (host PC: not shown) via the network interface 308. The image input unit 403 can also receive, as input data, image data scanned by a scanner (not shown) or the like in accordance with a scan job. Some apparatuses can designate image data stored in advance in the external storage device 304 to input the image data to the image input unit 403. The image data input method is arbitrary. These units serve as an image data unit for a print job. Assume that the input image data is bitmap image data.

The print setting input unit 406 makes various settings associated with printing including the number of copies, page layout, print order, and enlargement/reduction. Various settings can be input from, for example, a panel UI formed from the display 305 and operation unit 306. The print setting input unit 406 can also accept various settings as a control command together with image data transmitted from the host PC. These settings serve as print settings in a print job.

Based on print settings by the print setting input unit 406, the image editing unit 404 converts image data input from the image input unit 403 into print image data to be actually printed. The print settings include, for example, the number of copies, the number of pages to be imposed on a print medium, and designation of bookbinding printing. For example, when it is set by the page layout to print a plurality of pages on one page, the image editing unit 404 reduces respective target image data, and imposes the reduced image data at predetermined positions to newly create print image data. Details of print settings will be described later.

The image processing unit 405 performs image processes such as color conversion processing and halftone processing for print image data created by the image editing unit 404, and converts the processed print image data into an image format outputtable by the image output unit 409. Assume that image data corresponding to developing materials of four, cyan (C), magenta (M), yellow (Y), and black (K) are input to the image output unit 409. In this case, if a bitmap image input to the image input unit 403 is image data in the RGB color space, the image processing unit 405 executes conversion processing to convert the bitmap image data into image data in the CMYK color space by using a lookup table (LUT) or the like. In many cases, the image output unit 409 can output only a small number of tone levels such as 2, 4, or 16 tone levels. The image processing unit 405 executes pseudo halftone processing so that even the image output unit 409 capable of outputting only a small number of tone levels can achieve a stable halftone expression.

Generated bitmap image data is transferred as a video signal to the image output unit 409 via the engine interface 307, and undergoes print processing. The engine interface 307 has an output buffer for temporarily buffering a video signal to be transferred to the printer engine, and an input buffer for temporarily buffering a signal sent from the printer engine. The engine interface 307 forms an input/output unit for signals exchanged with the printer engine, and performs communication control with the printer engine.

In the first embodiment, input image data is analyzed, and the toner consumption amount of print image data that reflects print settings is predicted based on the analysis result. The toner consumption amount prediction unit 407 analyzes each input image data to calculate a toner consumption amount per print medium. The toner consumption amount of each image data may also be calculated by integrating pixel values on the assumption that the toner consumption amount is proportional to the pixel value of input image data. To increase the precision, pixel values weighted in accordance with the image characteristic may also be integrated. When the color space of input image data and that of image data to the image output unit are different, as described above, color conversion processing from the RGB space to the CMYK space needs to be done in advance in order to obtain a signal value corresponding to each developing material in the toner consumption amount prediction unit 407. After predicting the toner consumption amount of each image data, the toner consumption amount of print image data that reflects print settings from the print setting input unit 406 and complies with the print order is calculated.

(Prediction of Toner Consumption Amount)

Figures 5A, 5B:
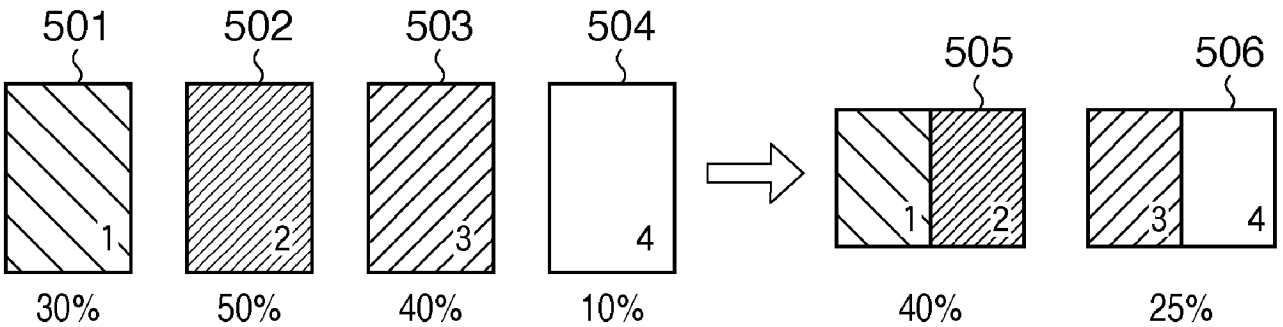
FIG. 5A is a view for explaining an example of predicting a toner consumption amount when reducing two images and printing them on one page in accordance with the page layout setting.
FIG. 5B is a table exemplifying a toner consumption amount prediction table complying with the print order of page layouts imposed based on print settings.

A detailed example of processing by the toner consumption amount prediction unit 407 will be explained. FIG. 5A is a view for explaining an example of predicting a toner consumption amount when reducing two images and printing them on one page in accordance with the page layout setting. Input image data are four image data 501 to 504. For descriptive convenience, the toner consumption amount of each image data is that of a single color toner. For a printer engine which prints out in color, toner consumption amounts suffice to be obtained independently for, for example, C, M, Y, and K corresponding to respective colors. For descriptive convenience, image data is handled as a solid image on the entire surface by averaging integrated pixel values. When no toner is consumed, that is, no image data corresponding to a target coloring material exists, the toner consumption amount is 0%. For a solid image, the toner consumption amount is 100%.

The toner consumption amount of each input image data is 30% for the image data 501, 50% for the image data 502, 40% for the image data 503, and 10% for the image data 504. When the two input image data 501 and 502 are reduced to newly create one image data 505, the toner consumption amount prediction unit calculates a toner consumption amount after layout by $$\text{(the toner consumption amount of the image data 501)/2+(the toner consumption amount of the image data 502)/2=30\%/2+50\%/2=40\%} \quad (1)$$

Similarly, when the two input image data 503 and 504 are reduced to newly create one image data 506, the toner consumption amount prediction unit calculates a toner consumption amount by $$\text{(the toner consumption amount of the image data 503)/2+(the toner consumption amount of the image data 504)/2=40\%/2+10\%/2=25\%} \quad (2)$$

Based on these calculation results, the toner consumption amount prediction unit 407 creates a toner consumption amount prediction table complying with the print order of page layouts imposed based on print settings, as shown in FIG. 5B.

The toner consumption amount prediction unit 407 predicts a toner consumption amount in advance for each image data, and predicts the toner consumption amount of image data to be printed that reflects print settings (page layout setting and the like). As a result, the toner consumption amount prediction unit 407 can create a toner consumption amount prediction table prior to printout.

Figures 6A, 6B, 6C:
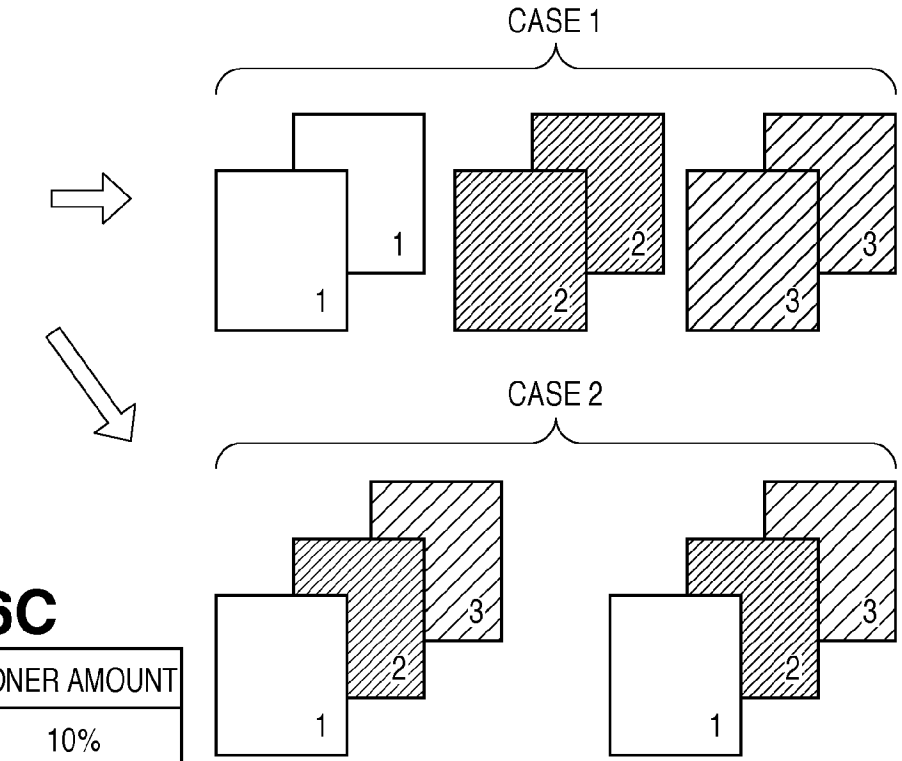
FIG. 6A is a view for explaining prediction of the toner consumption amount when printing a plurality of copies of the same image data.
FIGS. 6B and 6C are tables each exemplifying a toner consumption amount prediction table complying with the print order.

Another detailed example of processing by the toner consumption amount prediction unit 407 will be explained with reference to FIGS. 6A, 6B, and 6C. FIG. 6A is a view for explaining prediction of the toner consumption amount when printing a plurality of copies of the same image data. Input images are three image data 601 to 603. The toner consumption amount is 10% for the image data 601, 50% for the image data 602, and 25% for the image data 603. When each of the input image data is printed twice, the output order changes depending on the sorting method. Case 1 corresponds to a print setting of successively outputting two copies of each image data. Case 2 corresponds to a print setting of outputting two sets of the image data 601 to 603.

Based on these print settings, the toner consumption amount prediction unit 407 creates a toner consumption amount prediction table shown in FIG. 6B for case 1, and that shown in FIG. 6C for case 2.

The toner consumption amount prediction unit 407 predicts a toner consumption amount in advance for each image data, and predicts the toner consumption amount of print image data complying with the print order while reflecting the number of copies on the basis of print settings. The toner consumption amount prediction unit 407 can create a toner consumption amount prediction table prior to printout.

Figures 7A, 7B:
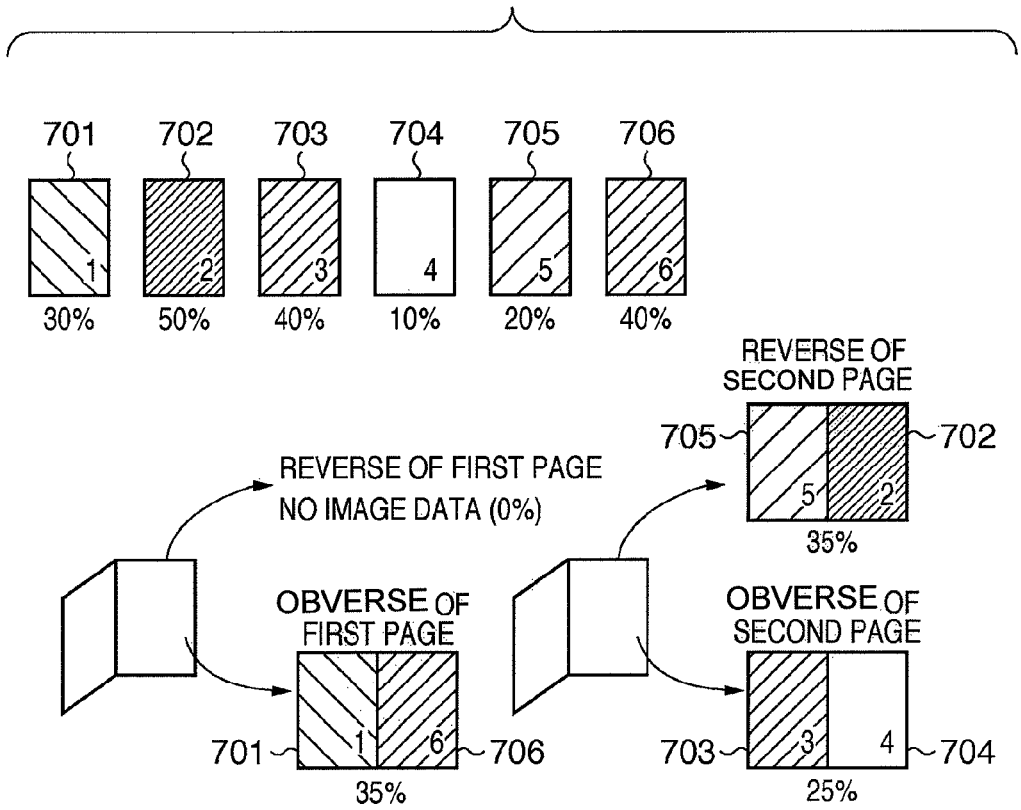
FIG. 7A is a view for explaining prediction of the toner consumption amount when performing "bookbinding printing" so that pages are arranged in a correct order upon saddle-stitching printed sheets.
FIG. 7B is a table exemplifying a toner consumption amount prediction table complying with the print order.

Still another detailed example of processing by the toner consumption amount prediction unit 407 will be explained with reference to FIGS. 7A and 7B. FIG. 7A is a view for explaining prediction of the toner consumption amount when performing "bookbinding printing" to arrange pages in a correct order upon saddle-stitching printed sheets. Prediction of the toner consumption amount reflecting the "bookbinding printing" setting is the above-described prediction considering the page layout setting and output order. Input image data are six image data 701 to 706. The toner consumption amount is 30% for the image data 701, 50% for the image data 702, 40% for the image data 703, 10% for the image data 704, 20% for the image data 705, and 40% for the image data 706.

When performing bookbinding printing requiring saddle stitching, image data of respective pages obtained by reducing images are as follows:

the obverse of the first page:
the image data 701 and 706
the reverse of the first page: no image data
the obverse of the second page:
the image data 703 and 704
the reverse of the second page:
the image data 705 and 702

When performing double-sided printing by a printer which prints the reverse of a page as the first page and its obverse as the second page, the output order is as follows:

the reverse of the first page (Page ID: 1)→the obverse of the first page (Page ID: 2)→the reverse of the second page (Page ID: 3)→the obverse of the second page (Page ID: 4).

Based on these print settings, the toner consumption amount prediction unit 407 creates a toner consumption amount prediction table complying with the print order as shown in FIG. 7B.

The toner consumption amount prediction unit 407 predicts a toner consumption amount in advance for each image data, and predicts the toner consumption amount of print image data at a proper timing while reflecting the bookbinding setting. Accordingly, the toner consumption amount prediction unit 407 can create a toner consumption amount prediction table prior to bookbinding printout.

Based on the toner consumption amount prediction table predicted by the toner consumption amount prediction unit 407 in the above-described manner, the supply schedule generation unit 408 generates a supply schedule which defines the toner supply amount and supply timing. The supply schedule describes the toner supply timing with respect to the operation of the printer engine in printing. The supply control unit 410 supplies toner to the development device in accordance with the created supply schedule.

Figure 13:
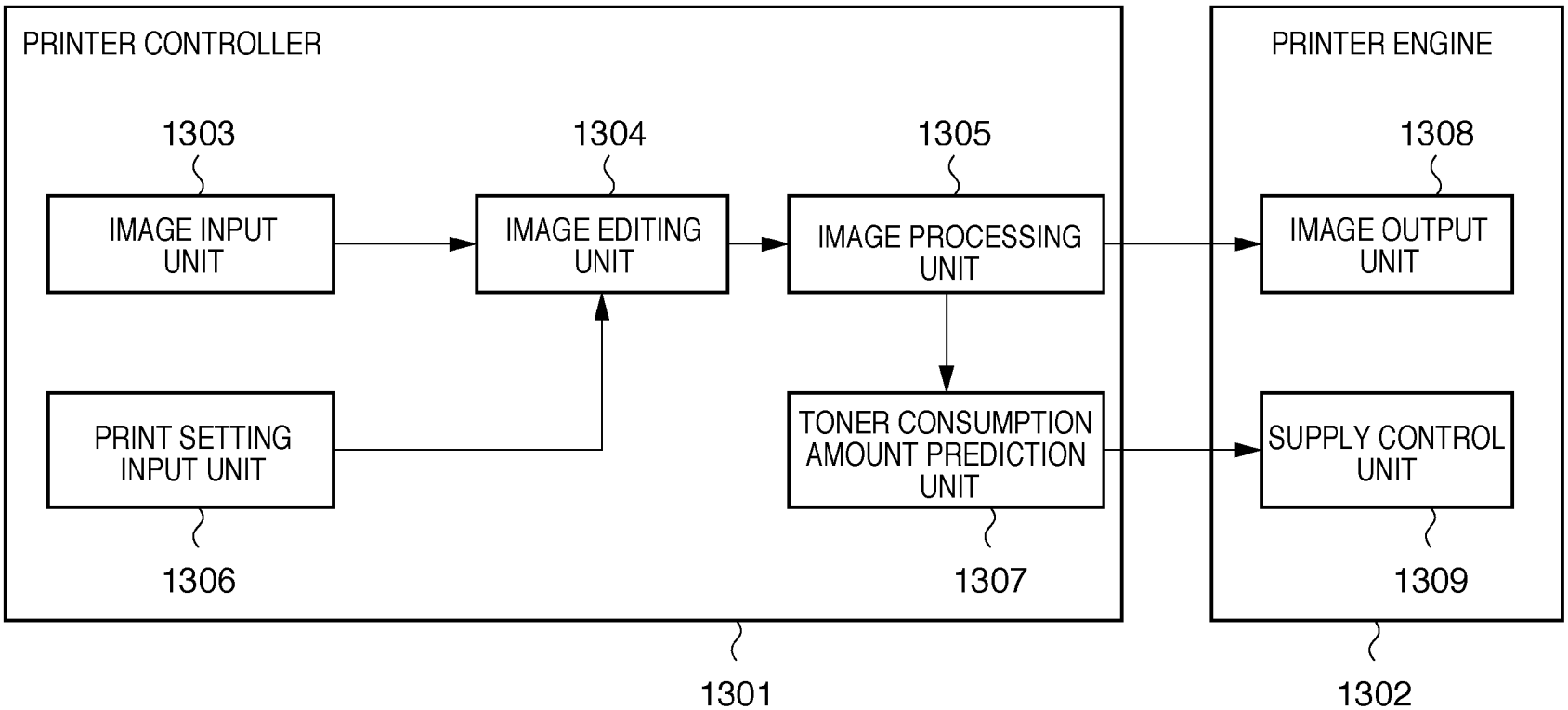
FIG. 13 is a block diagram exemplifying toner supply using a conventional video count method.

To clarify the feature of the toner supply timing according to the embodiment of the present invention, an example of toner supply according to a conventional technique will be explained with reference to FIG. 13. FIG. 13 is a block diagram showing the arrangement of an image forming apparatus which executes conventional video count type developing material control. The arrangement in FIG. 13 is the same as that in FIG. 4 except a toner consumption amount prediction unit 1307 in FIG. 13, and a detailed description of the respective functions will not be repeated. In the conventional video count type developing material control, an image editing unit 1304 creates, for image data input from an image input unit 1303, print image data complying with the layout, order, and the like of actual printing in accordance with values set by a print setting input unit 1306. The created print image data undergoes necessary image processing by an image processing unit 1305, and is transmitted as print data to an image output unit 1308. Parallel to the image processing, the toner consumption amount prediction unit 1307 predicts the toner consumption amount of print data by obtaining a video count value on the basis of the signal value of print image data to be actually printed. Hence, creation of print data to be actually printed and prediction of the toner consumption amount are executed almost simultaneously.

Figure 8A:
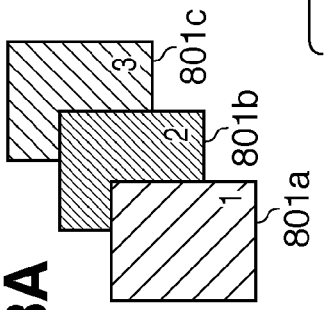
FIG. 8A is a view showing input image data.
Figure 8B:
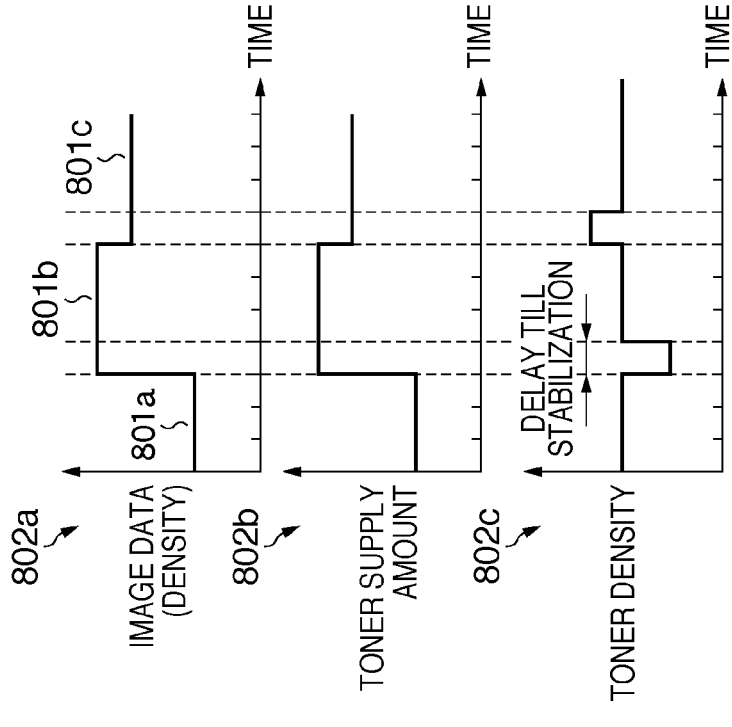
FIG. 8B is a timing chart showing a toner supply amount under conventional video count type developing material density control, and the transition of the toner density in the development unit.
Figure 8C:
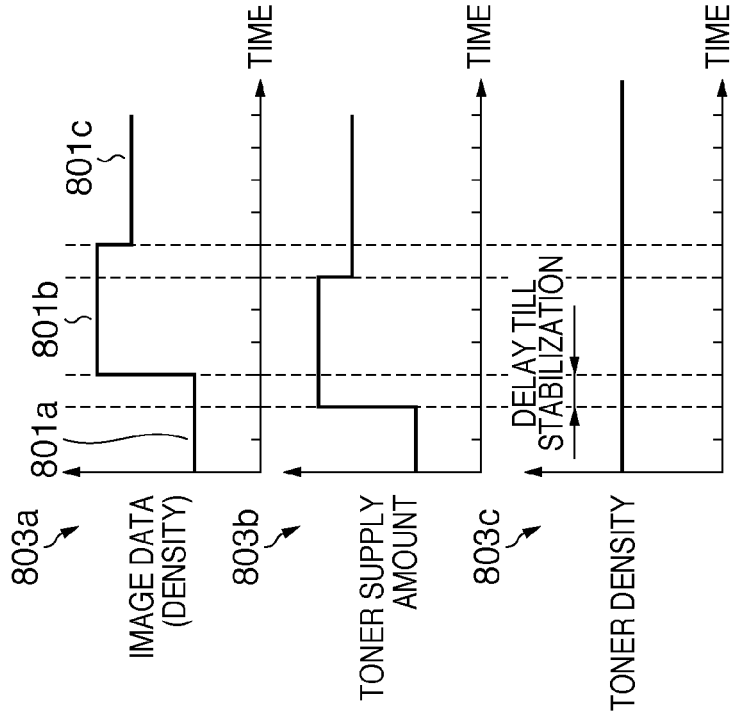
FIG. 8C is a timing chart showing a toner supply amount complying with a supply schedule according to the embodiment, and the transition of the toner density in the development unit.

Referring back to the description of the embodiment of the present invention, the toner supply timing will be explained with reference to FIGS. 8A, 8B, and 8C. FIG. 8A shows input image data 801*a*, 801*b*, and 801*c*. FIG. 8B is a timing chart showing a toner supply amount under the conventional video count type developing material density control, and the transition of the toner density in the development unit. FIG. 8C is a timing chart showing a toner supply amount complying with a supply schedule according to the embodiment, and the transition of the toner density in the development unit.

Reference numerals 802*a* in FIG. 8B and 803*a* in FIG. 8C represent the print timings of the image data shown in FIG. 8A and image densities at these timings. When the conventional video count type developing material density control is done, the toner supply amount is determined parallel to image processing of image data to be printed. Hence, toner is supplied at almost the same time as printing, as represented by 802*b* in FIG. 8B. As described above, a supplied toner moves or diffuses in the development unit to stabilize the toner density. As is apparent from 802*b* in FIG. 8B, the conventional video count method does not consider the time for movement and diffusion. Hence, during a "delay till stabilization", the toner density is not uniform, and the printed image may not be stabilized, as represented by 802*c* in FIG. 8C.

To the contrary, according to the supply schedule in the embodiment of the present invention, a toner consumption amount complying with the layout information and print order can be predicted in advance on the basis of print settings before creating bitmap image data to be actually printed on the basis of print settings. The toner supply schedule is created by predicting the toner consumption amount of each image data and predicting the toner density in the development unit prior to print processing. In actual processing, after creating the toner supply schedule, the process may also shift to image editing processing in consideration of the delay time until the toner density stabilizes. By considering the delay time until the toner density stabilizes, the toner density in executing printing can be made uniform.

The toner supply timing based on the toner supply schedule generated by the supply schedule generation unit 408 precedes generation of image data, as represented by 803*b* in FIG. 8C. The toner supply timing considers the delay time until the toner density stabilizes, including the time taken for movement and diffusion of toner. As represented by 803*c* in FIG. 8C, the toner density in the development unit can be made uniform, stabilizing a printed image.

It is also possible to arrange the print setting input unit 406, toner consumption amount prediction unit 407, and supply schedule generation unit 408 in the host PC, and perform prediction of the toner consumption amount and generation of the supply schedule by the host PC on the basis of bitmap image data and print settings. In this case, the printer controller can receive the supply schedule together with image data, and thus can start toner supply earlier.

According to the first embodiment, when performing print processing, the contents of a print job are analyzed, and a toner consumption amount complying with the print order is predicted from print settings on the basis of the analysis result. The toner density in the development unit can be predicted from the toner consumption amount to generate a toner supply schedule and supply toner at a proper timing.

Second Embodiment

The first embodiment is premised on that the toner consumption amount of each input image data is analyzed in advance. For this purpose, input image data needs to be held as a bitmap image for analysis in the external storage device 304 such as a hard disk. However, when the host PC or the like transmits a print job to the image forming apparatus, it generally transmits not a bitmap image directly, but a drawing command for creating page image data. The image forming apparatus such as a printer needs to shorten the time till printing upon receiving a print job, and cannot take a long time for analyzing image data. The second embodiment will explain an arrangement for implementing toner supply developing material density control which shortens the time lag when executing a print job based on a drawing command.

Figure 9:
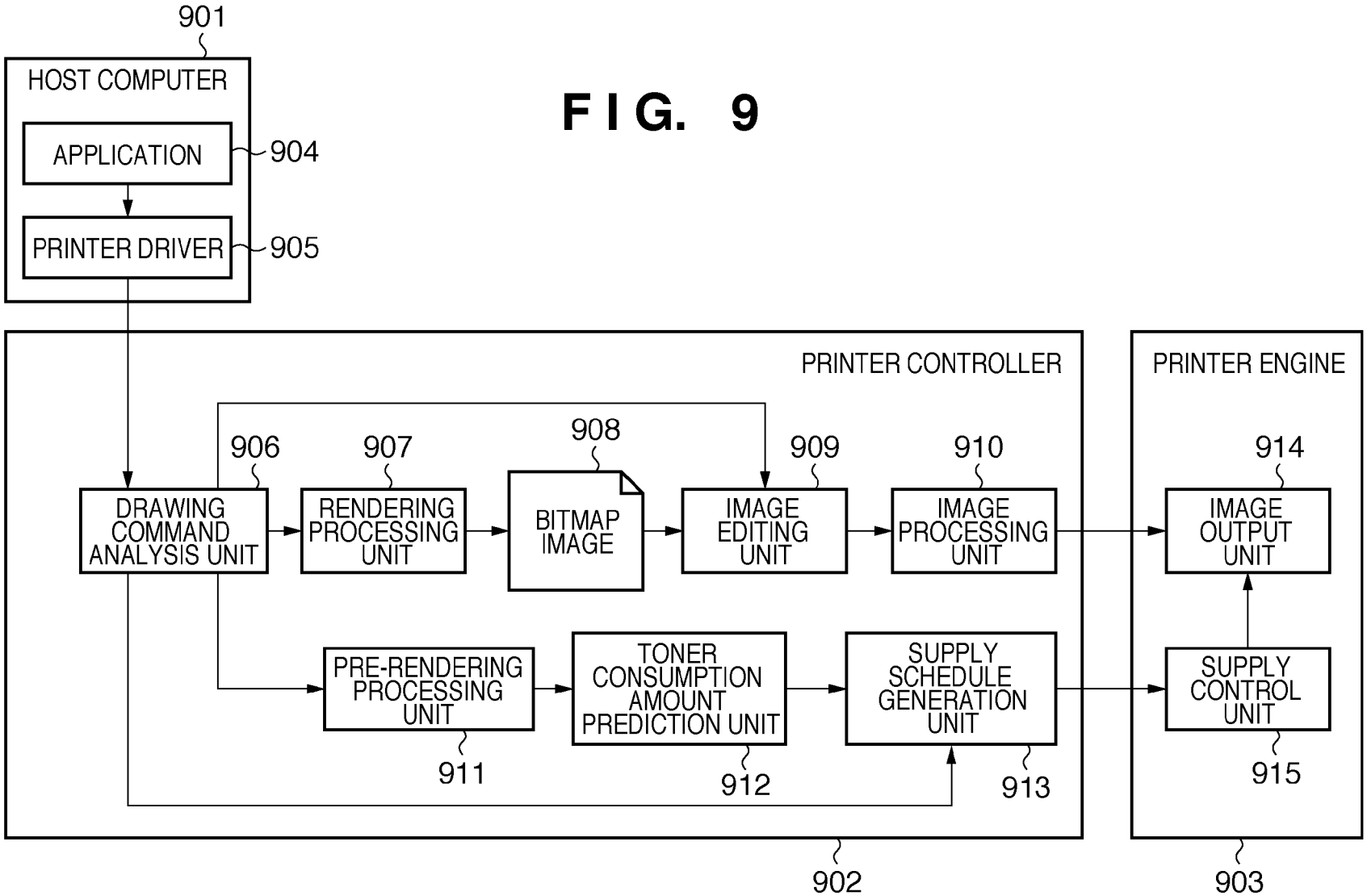
FIG. 9 is a block diagram showing the functional arrangement of an image forming apparatus according to the second embodiment.

FIG. 9 is a block diagram showing the functional arrangement of an image forming apparatus according to the second embodiment of the present invention. An application 904 which runs on a host computer 901 can be used to create a page layout document, wordprocessing document, graphic document, and the like. Digital document data created by the application 904 is transmitted to a printer driver 905, which generates a drawing command based on the digital document. Assume that the generated drawing command is described in PDL (Page Description Language) for creating page image data. The drawing command generally includes an instruction to draw image data such as an image, graphic, and text, and as a control instruction, print settings regarding the number of copies, page layout, and print order.

A drawing command transmitted from the host computer 901 is analyzed by a drawing command analysis unit 906 in a printer controller 902. The analysis processing by the drawing command analysis unit 906 generates a drawing object which is an intermediate language processible by a rendering processing unit 907. At this time, a control instruction which is contained in the drawing command and associated with print settings is also extracted. The rendering processing unit 907 executes rendering processing to generate a bitmap image 908. Based on the print settings extracted by the drawing command analysis unit 906, an image editing unit 909 converts the generated bitmap image 908 into print image data to be actually printed. An image processing unit 910 converts the created print image data into an image signal which can be transferred to a printer engine 903. By transferring the image signal to an image output unit 914, print processing is executed.

In the second embodiment, the toner consumption amount is predicted from a drawing object created by the drawing command analysis unit 906 before rendering processing. The drawing object is described in an intermediate language before rendering processing. Most input image data such as graphics and a text are described as vector information.

Figure 10:
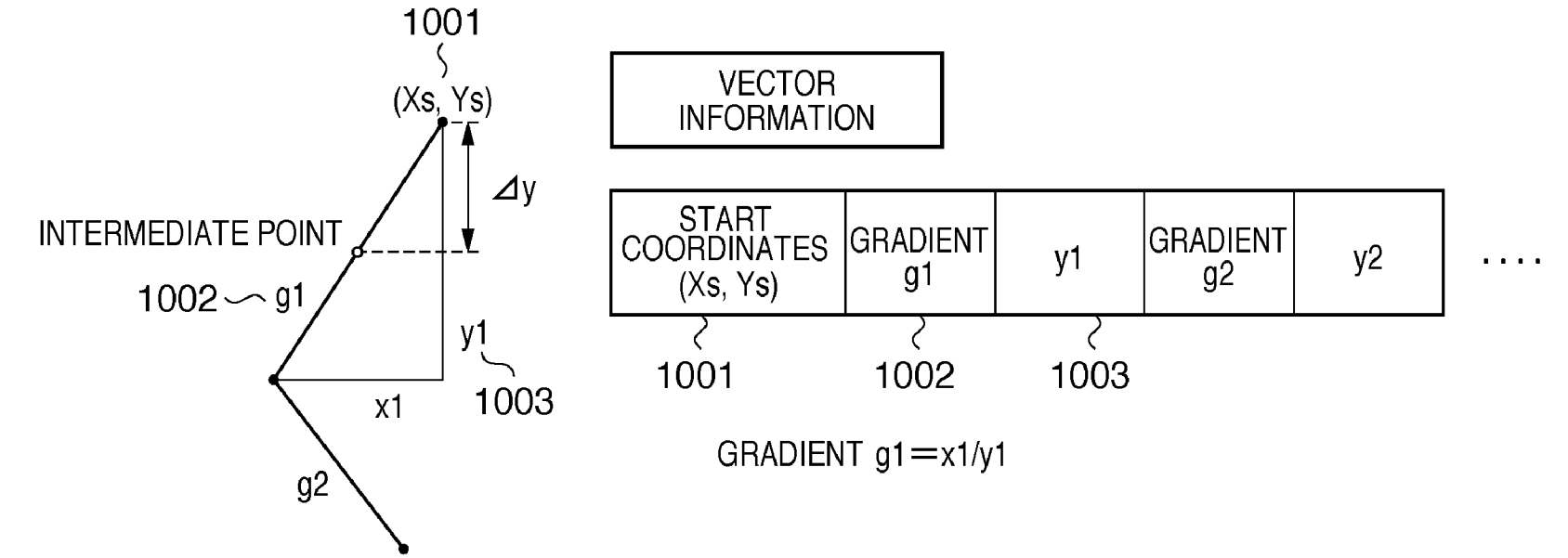
FIG. 10 is a view showing an example of a drawing object described as vector information.

FIG. 10 is a view showing an example of a drawing object described as vector information. As shown in FIG. 10, the vector information is formed from a start point (Xs,Ys) 1001 of the drawing object, a gradient g1 1002, and a Y-coordinate distance y1 1003 up to the change point of the gradient in terms of edge information of an image. Edge information is held as vector information because of high memory efficiency. Edge information of the entire page is basically held as vector information. Note that image data generally contains color painting information in addition to the edge information. In normal printing, the drawing object is converted into the bitmap image 908 by obtaining the pixel value of each pixel by the rendering processing unit 907 in accordance with a target resolution.

As an application of the conventional technique, assume that a bitmap image having undergone rendering processing in normal printing is analyzed to predict a toner consumption amount. The created bitmap image is processed by the image editing unit and image processing unit, and then transferred to the printer engine. Parallel to this, a supply schedule is created. Thus, toner is supplied at almost the same time as printing, so the timing of supply is late. To determine the toner supply amount, a bitmap image may also be generated separately from normal printing. However, this decreases the print processing speed and memory efficiency.

Figure 11:
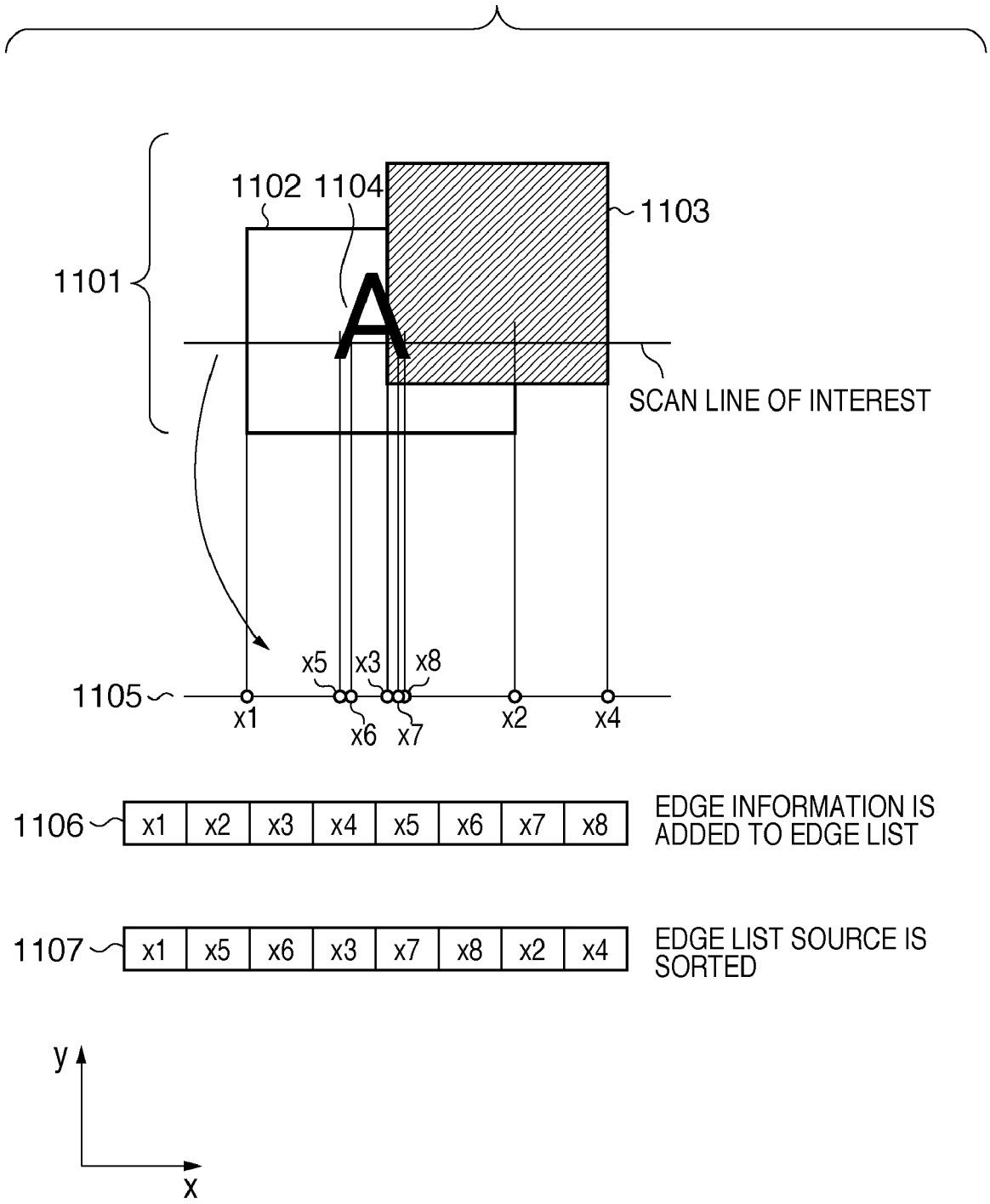
FIG. 11 is a view exemplifying pre-rendering processing.

Referring back to the description of the second embodiment, in order to prevent the delay of the toner supply timing and increase the memory efficiency, a pre-rendering processing unit 911 in the second embodiment performs pre-rendering processing for a drawing object to predict the toner consumption amount. FIG. 11 is a view exemplifying pre-rendering processing.

Image data 1101 undergoes pre-rendering processing. A feature of the pre-rendering processing in the second embodiment is to convert edge information described by vector information as a drawing object into an edge list arrayed in coordinate information of each scan line of interest. The image data 1101 is formed from graphics 1102 and 1103 and a text 1104. In pre-rendering processing, edge information on a given scan line is held as position information. Coordinate information (coordinate information in the scan line direction (X direction)) which forms edge information on a scan line of interest is arrayed as represented by reference numeral 1105. On the scan line of interest in the image data 1101, the edges of the graphics 1102 are represented by x1 and x2. Similarly, the edges of the graphics 1103 are represented by x3 and x4, and those of the text 1104 are represented by x5, x6, x7, and x8. The pieces of edge information are added to an edge list 1106. After all pieces of edge information of a given scan line are extracted, edges at X-coordinates are sorted again to create an edge list 1107. The edge list can be created by simple arithmetic processing, which is advantageous for memory efficiency as well.

Based on the edge list, a toner consumption amount prediction unit 912 can specify a drawing range in each scan line direction. Based on the edge list created by the pre-rendering processing unit 911, the toner consumption amount prediction unit 912 calculates the toner consumption amount per page of each input image data. More specifically, the toner consumption amount prediction unit 912 estimates the number of pixels in given painting information on the basis of the created edge list. The edge list holds the X-coordinate of an edge at which painting information is switched. The number of pixels of painting information on a given scan line can be easily acquired by referring to the edge list. By adding the numbers of pixels on all scan lines, the toner consumption amount per page (print medium) of image data can be calculated. Processing to calculate the toner consumption amount per page of image data is the same as that in the above-described first embodiment.

The number of copies, page layout, print order, and the like are set in a control instruction contained together with image data in a drawing command from the host PC. The toner consumption amount prediction unit 912 can acquire the print settings of image data from a control instruction analyzed by the drawing command analysis unit. The toner consumption amount prediction unit 912 creates a toner consumption amount prediction table from the toner consumption amounts and print settings of respective image data. A supply schedule calculation method after creating the toner consumption amount prediction table is the same as that in the first embodiment, and a detailed description thereof will not be repeated.

In the second embodiment, the toner consumption amount prediction table can be created before creating a bitmap image on the basis of print settings. Hence, when creating a supply schedule, the start of the supply operation can be scheduled before processing by the image processing unit 910. Starting the supply operation prior to print processing by the printer engine enables toner supply considering movement and diffusion of the developing material in the development unit.

In the second embodiment, even upon receiving a drawing command, pre-rendering processing is executed to analyze the contents of a print job. Then, a toner consumption amount complying with the print order is predicted from print settings, and the toner density in the development unit is predicted in advance to generate a toner supply schedule. Toner can be supplied at a proper timing without greatly decreasing the print speed.

Third Embodiment

In the first and second embodiments, input image data and a drawing command are analyzed, and the toner density in the development unit is predicted based on print settings to create a supply schedule and control the density of the developing material. However, the prediction precision of the toner consumption amount based on input image data or the like may suffer an error depending on the characteristic of image data. The toner supply amount from the supply device may also suffer an error. In the third embodiment, the toner consumption amount and the state in the development unit are detected using a density sensor for detecting the toner density. In prediction of the toner consumption amount, a predicted toner consumption amount is corrected based on an actually detected toner density in addition to input image data, information of print settings, and the like. As a result, the toner consumption amount is predicted at higher prediction.

Figure 12A:
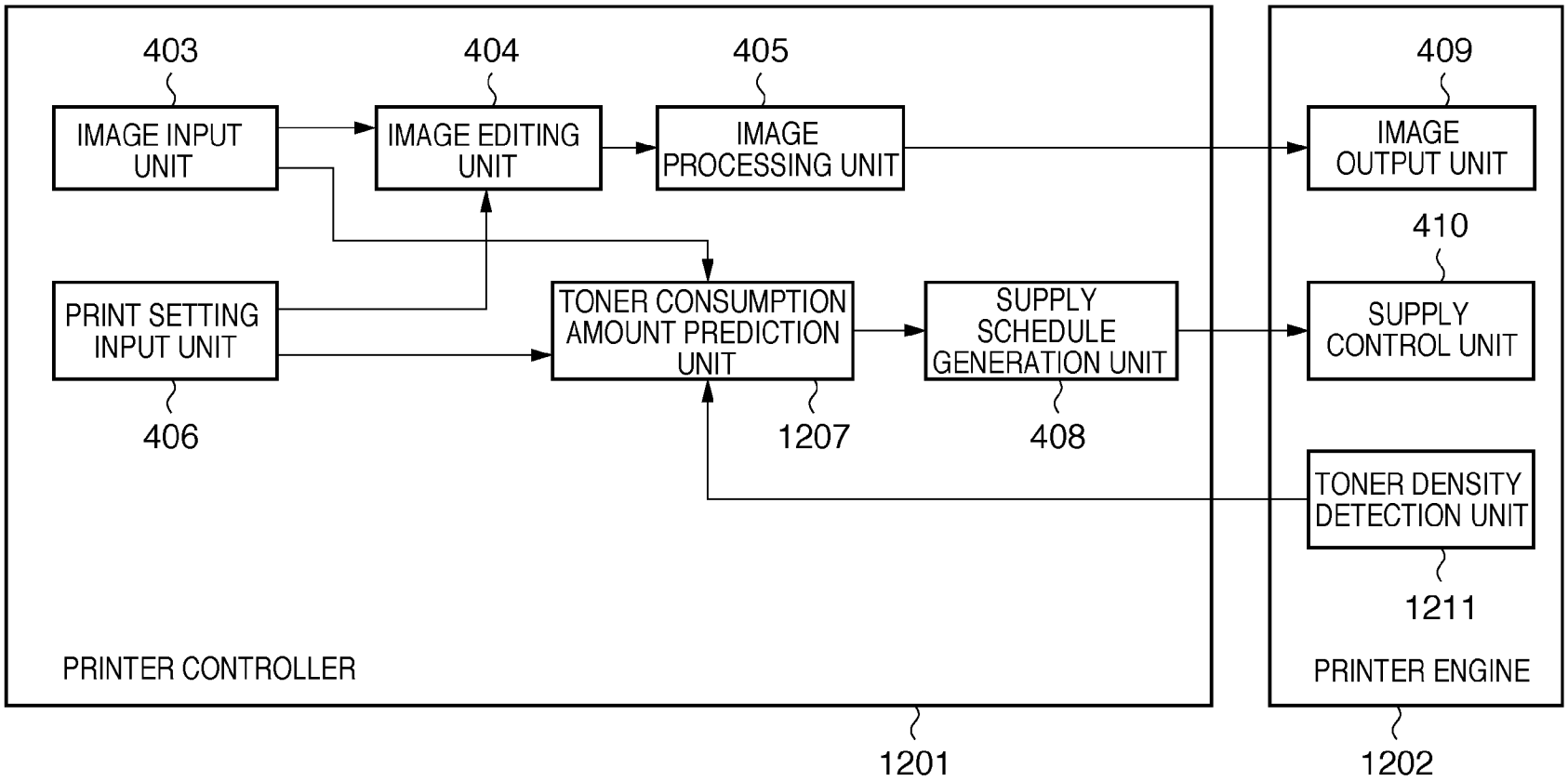
FIG. 12A is a block diagram showing the functional arrangement of an image forming apparatus according to the third embodiment.

FIG. 12A is a block diagram showing the functional arrangement of an image forming apparatus according to the third embodiment. The functional arrangement of the image forming apparatus according to the third embodiment is different from the arrangement in FIG. 4 in that a toner consumption amount prediction unit 1207 is changed in a printer controller 1201, and a toner density detection unit 1211 is added to a printer engine 1202. The arrangement according to the third embodiment is applicable not only to the arrangement in FIG. 4 according to the first embodiment, but also to that in FIG. 9 according to the second embodiment.

The toner density detection unit 1211 detects an actual toner density in the development unit by using a toner density detection sensor or the like. By measuring a toner density in the development unit upon outputting given image data, an actually consumed toner amount can be detected. As described in the first embodiment, the toner consumption amount prediction unit 1207 analyzes image data, and predicts a toner consumption amount complying with the print order in consideration of the analysis result and print settings. As for the predicted toner consumption amount, the toner consumption amount prediction unit 1207 corrects, based on an actual toner consumption amount obtained from the toner density detection unit 1211, a parameter for calculating a predicted value.

When performing print processing, the toner consumption amount prediction unit 1207 analyzes the contents of a print job to predict a toner consumption amount complying with the print order in accordance with print settings. When print processing is executed, an actual toner consumption amount is detected using the density sensor or the like. Based on the detection result, the toner consumption amount prediction unit 1207 compares the predicted toner consumption amount with the actual one. Based on the comparison result, the toner consumption amount prediction unit 1207 corrects the parameter for calculating the predicted value of the toner consumption amount. By feeding back an actual toner consumption amount to the toner consumption amount predicted value calculation process, the toner density in the development unit can be predicted at high precision. A supply schedule generation unit 408 can generate a toner supply schedule on the basis of the high-precision predicted value of the toner consumption amount.

The predicted value of the toner consumption amount is corrected using the following prediction equations (calculation process). Note that the gist of the present invention is not limited to the use of the following prediction equations. The functions suffice to be able to interpolate the relationship between a measured value and a predicted value.

| | | |
|---|---|---|
| Cyan | $Y_c = X_c \times GAIN_c + OFFSET_c$ | |
| Magenta | $Y_m = X_m \times GAIN_m + OFFSET_m$ | |
| Yellow | $Y_y = X_y \times GAIN_y + OFFSET_y$ | |
| Black | $Y_k = X_k \times GAIN_k + OFFSET_k$ | . . . (1) |

The prediction equations are used independently for C, M, Y, and K used in a printer. The cyan prediction equation will be exemplified.

$Y_c$ is the predicted value (corrected predicted value) of the toner consumption amount after correction. $X_c$ is the predicted value (uncorrected predicted value) of the toner consumption amount that is obtained from image data and print settings. $GAIN_c$ and $OFFSET_c$ are parameters (gain value and offset value) for adjusting an uncorrected predicted value to a corrected predicted value. The toner consumption amount prediction unit 1207 compares the predicted value (corrected predicted value) of the toner consumption amount with an actually consumed toner amount detected by the toner density detection unit. The toner consumption amount prediction unit 1207 sets, finely adjusts, and updates a gain value and offset value so as to, for example, make the two toner consumption amounts equal to each other. By using the set and updated parameters (gain value $GAIN_c$ and offset value $OFFSET_c$), the toner consumption amount prediction unit 1207 corrects the predicted value (uncorrected predicted value) $X_c$ of the toner consumption amount. The toner consumption amount prediction unit 1207 obtains the predicted value (corrected predicted value) $Y_c$ of the toner consumption amount on the basis of the corrected parameters.

The relationship between the signal value of image data and the toner consumption amount tends to depend on the image data characteristic (e.g., image, graphics, or text) and the image forming method. Hence, different gains and offsets can be set for objects of respective colors to achieve higher-precision toner prediction. FIG. 12B is a table showing an example of setting gain values and offset values of respective colors for, for example, an image, graphics, and text as image data characteristics.

Higher-precision predicted values of toner consumption amounts can be obtained by correcting predicted toner consumption amounts $X_c$, $X_m$, $X_y$, and $X_k$ using the gain values and offset values shown in FIG. 12B.

The toner consumption amount prediction unit 1207 predicts a toner consumption amount from image data and print settings, corrects the predicted value on the basis of a toner consumption amount detected by the toner density detection unit 1211, and then creates a toner consumption amount prediction table. A supply schedule calculation method after creating the toner consumption amount prediction table is the same as that in the first embodiment, and a detailed description thereof will not be repeated.

According to the third embodiment, the toner consumption amount detection result is reflected in a predicted value. The toner density in the development unit can be predicted at high precision to schedule toner supply and supply toner at a proper timing.

Other Embodiments

The object of the present invention is also achieved by supplying a computer-readable storage medium which stores software program codes for implementing the functions of the above-described embodiments to a system or apparatus. The object of the present invention is also achieved by reading out and executing the program codes stored in the storage medium by the computer (or the CPU or MPU) of the system or apparatus.

In this case, the program codes read out from the storage medium implement the functions of the above-described embodiments, and the storage medium which stores the program codes constitutes the present invention.

The storage medium for supplying the program codes includes a flexible disk, hard disk, optical disk, magnetooptical disk, CD-ROM, CD-R, nonvolatile memory card, and ROM.

The functions of the above-described embodiments are implemented when the computer executes the readout program codes. Also, the present invention includes a case where an OS (Operating System) or the like running on the computer performs part or all of actual processing on the basis of the instructions of the program codes and thereby implements the above-described embodiments.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-042072, filed Feb. 22, 2008, which is hereby incorporated by reference herein in its entirety.

What is claimed is:

1. An image forming apparatus having a development unit which develops an electrostatic latent image formed on an image carrier to form a visible image, the apparatus comprising:

an input unit adapted to accept input of a print job;

an analysis unit adapted to analyze contents of image data included in the print job and contents of a print setting for controlling printout based on the image data;

a prediction unit adapted to predict, based on an analysis result by said analysis unit, a consumption amount of a developing material necessary to develop an electrostatic latent image by the development unit when an electrostatic latent image based on the image data is formed; and a supply control unit adapted to control, based on the consumption amount of the developing material that is predicted by said prediction unit, a supply unit which supplies the developing material to the development unit.

2. The apparatus according to claim 1, further comprising:

a drawing command analysis unit adapted to analyze an image data drawing instruction and a control instruction associated with a print setting from a drawing command received as the print job; and a pre-rendering processing unit adapted to convert edge information of a drawing object before rendering processing that is generated based on the analysis result by said drawing command analysis unit into an edge list arrayed in coordinate information in a scan line direction of interest, wherein before the drawing object is rendered, said prediction unit specifies a drawing range in each scan line direction on the basis of the edge list, and predicts a consumption amount of a developing material necessary to develop an electrostatic latent image by the development unit when an electrostatic latent image corresponding to the drawing range is formed.

3. The apparatus according to claim 1, further comprising a detection unit adapted to detect a consumption amount of a developing material, wherein said prediction unit corrects, based on the consumption amount of the developing material that is detected by said detection unit, a parameter for calculating a predicted value of the consumption amount of the developing material.

4. The apparatus according to claim 1, further comprising an image processing unit adapted to generate an image signal for forming an electrostatic latent image on the image carrier on the basis of the image data, wherein said supply control unit controls the supply unit to start supply of the developing material before said image processing unit generates the image signal.

5. The apparatus according to claim 1, wherein the print setting includes the number of copies, the number of pages to be imposed on a print medium, and designation of bookbinding printing.

6. A method of controlling an image forming apparatus having a development unit which develops an electrostatic latent image formed on an image carrier to form a visible image, the method comprising:

an input step of accepting input of a print job;

an analysis step of analyzing contents of image data included in the print job and contents of a print setting for controlling printout based on the image data;

a prediction step of predicting, based on an analysis result in the analysis step, a consumption amount of a developing material necessary to develop an electrostatic latent image by the development unit when an electrostatic latent image based on the image data is formed; and a supply control step of controlling, based on the consumption amount of the developing material that is predicted in the prediction step, a supply unit which supplies the developing material to the development unit.

7. The method according to claim 6, further comprising:

a drawing command analysis step of analyzing an image data drawing instruction and a control instruction associated with a print setting from a drawing command received as the print job; and a pre-rendering processing step of converting edge information of a drawing object before rendering processing that is generated based on the analysis result in the drawing command analysis step into an edge list arrayed in coordinate information in a scan line direction of interest, wherein before the drawing object is rendered, in the prediction step, a drawing range in each scan line direction is specified based on the edge list, and a consumption amount of a developing material necessary to develop an electrostatic latent image by the development unit when an electrostatic latent image corresponding to the drawing range is formed is predicted.

8. The method according to claim 6, further comprising a detection step of detecting a consumption amount of a developing material, wherein in the prediction step, a parameter for calculating a predicted value of the consumption amount of the developing material is corrected based on the consumption amount of the developing material that is detected in the detection step.

9. The method according to claim 6, further comprising an image processing step of generating an image signal for forming an electrostatic latent image on the image carrier on the basis of the image data, wherein in the supply control step, the supply unit is controlled to start supply of the developing material before the image signal is generated in the image processing step.

10. The method according to claim 6, wherein the print setting includes the number of copies, the number of pages to be imposed on a print medium, and designation of bookbinding printing.

11. A program which is stored in a computer-readable storage medium and causes a computer to execute an image forming apparatus control method defined in claim 6.

12. A computer-readable storage medium storing a program defined in claim 11.

13. An image forming apparatus having a development unit which develops an electrostatic latent image formed on an image carrier to form a visible image, the apparatus comprising:

an input unit adapted to accept input of a print job;

an analysis unit adapted to analyze contents of image data included in the print job and contents of a print setting for controlling printout based on the image data;

a prediction unit adapted to predict, based on an analysis result by said analysis unit, a consumption amount of a developing material necessary to develop an electrostatic latent image by the development unit when an electrostatic latent image based on the image data is formed; and a supply control unit adapted to control, before forming an image among the image data which is determined to require stabilization of a density of the developing material based on the consumption amount of the developing material that is predicted by said prediction unit, a supply unit which supplies the developing material to the development unit.

14. A method of controlling an image forming apparatus having a development unit which develops an electrostatic latent image formed on an image carrier to form a visible image, the method comprising:

an input step of accepting input of a print job;

an analysis step of analyzing contents of image data included in the print job and contents of a print setting for controlling printout based on the image data;

a prediction step of predicting, based on an analysis result in the analysis step, a consumption amount of a developing material necessary to develop an electrostatic latent image by the development unit when an electrostatic latent image based on the image data is formed; and a supply control step of controlling, before forming an image among the image data which is determined to require stabilization of a density of the developing material based on the consumption amount of the developing material that is predicted in the prediction step, a supply unit which supplies the developing material to the development unit.

* * * * *